US007789377B2

(12) United States Patent
Gallea

(10) Patent No.: US 7,789,377 B2
(45) Date of Patent: Sep. 7, 2010

(54) FENCE POST CAP ASSEMBLY

(76) Inventor: Kimberly A. Gallea, 26 Benson St., Apt. C, West Haverstraw, NY (US) 10993

( * ) Notice: Subject to any disclaimer, the term of this patent is extended or adjusted under 35 U.S.C. 154(b) by 0 days.

(21) Appl. No.: 11/591,874

(22) Filed: Nov. 3, 2006

(65) Prior Publication Data

US 2008/0105860 A1 May 8, 2008

(51) Int. Cl.
*E04H 17/00* (2006.01)

(52) U.S. Cl. ..... 256/65.02; 256/1; 256/32; 256/65.04

(58) Field of Classification Search ... 256/65.02–65.04, 256/65.06, 65.12, 1, 32; 248/65, 71, 73; 403/205, 209, 213, 235, 295, 397, 398, 211, 403/212, 216; 52/300; 24/136 L
See application file for complete search history.

(56) References Cited

U.S. PATENT DOCUMENTS

| | | | | |
|---|---|---|---|---|
| 340,263 | A | 4/1886 | Weber | |
| 438,122 | A | 10/1890 | Tharp | |
| 505,781 | A | 9/1893 | Vance | |
| 515,155 | A * | 2/1894 | Nelson | 24/136 L |
| 1,237,837 | A | 8/1917 | Sundh | |
| 1,316,155 | A | 9/1919 | Frazier | |
| 1,440,852 | A * | 1/1923 | Thomson | 256/11 |
| 1,822,389 | A | 9/1931 | Blakely | |
| 2,062,408 | A | 12/1936 | Edge | |
| 2,212,455 | A | 8/1940 | Reed | |
| 2,268,430 | A * | 12/1941 | Silbernagel | 403/215 |
| 2,337,895 | A * | 12/1943 | Boleslaw | 403/211 |
| 2,681,822 | A * | 6/1954 | Daniels | 403/169 |
| 2,954,212 | A * | 9/1960 | Cox | 256/11 |
| 3,211,829 | A * | 10/1965 | Brautigam | 403/212 |
| 3,352,581 | A | 11/1967 | Robbins et al. | |
| 3,428,300 | A | 2/1969 | Sconzo | |
| 3,462,804 | A * | 8/1969 | Renaudin | |
| 3,749,368 | A * | 7/1973 | Miller | 256/11 |
| 3,861,813 | A * | 1/1975 | Seron | 403/216 |
| D239,039 | S | 3/1976 | Hirst | |
| 3,972,639 | A * | 8/1976 | Lening | 256/59 |
| 4,039,166 | A | 8/1977 | Elgin | |
| 4,103,875 | A | 8/1978 | Glass | |
| 4,112,551 | A * | 9/1978 | Sales | 403/211 |
| 4,136,985 | A | 1/1979 | Taul | |
| 4,150,907 | A | 4/1979 | Thurnauer | |
| 4,159,820 | A | 7/1979 | Parisien | |
| 4,215,890 | A * | 8/1980 | Savage | |

(Continued)

FOREIGN PATENT DOCUMENTS

EP 1193419 A1 * 4/2002

*Primary Examiner*—Victor MacArthur
(74) *Attorney, Agent, or Firm*—Dan M. DeLaRosa

(57) ABSTRACT

A fence post cap assembly is provided, the assembly comprises a first cap member designed to attach onto a fence post; a second cap member having a circumference larger than the first cap member, the second cap member is designed to fit over the first cap member, the second cap member having at least two apertures; and a loop member having a rounded portion leading to two arms with opposing ends, during an installed position, each of the ends are designed to fit within the apertures of the second cap member while the second cap member is placed over the first cap member thereby locking the loop member and the second cap member onto the first cap member.

17 Claims, 8 Drawing Sheets

U.S. PATENT DOCUMENTS 4,361,314 A 11/1982 Ohlson
4,379,536 A * 4/1983 Mizuno et al. ..... 248/73
D269,209 S 5/1983 Hegarty
4,408,748 A 10/1983 Lewis
4,520,231 A 5/1985 Hubbell
4,623,756 A 11/1986 Wilson, Jr.
4,680,428 A 7/1987 Wilson, Jr.
4,782,560 A * 11/1988 Keller ..... 24/136 L
4,844,420 A 7/1989 Oster
4,991,823 A 2/1991 Stanish, Jr.
5,291,708 A 3/1994 Johnson
5,332,196 A 7/1994 Wright
5,383,905 A * 1/1995 Golds et al.
5,419,536 A 5/1995 Bender
5,421,556 A 6/1995 Dodge et al.
5,474,279 A 12/1995 Parisien
5,481,244 A * 1/1996 Dicke
5,547,169 A 8/1996 Russell
5,645,270 A 7/1997 Lawrence
5,651,533 A 7/1997 Ling
5,660,376 A 8/1997 West
5,662,313 A * 9/1997 Forrester ..... 256/11
D391,377 S 2/1998 Langlie et al.
5,785,447 A 7/1998 Fonti et al.
5,806,813 A * 9/1998 Binelli ..... 248/73
5,853,167 A 12/1998 West et al.
5,931,450 A 8/1999 Yoder
6,076,807 A 6/2000 Spence
6,217,007 B1 4/2001 Grayson, II et al.
D444,243 S 6/2001 Erwin
6,305,672 B1 10/2001 Case et al.
D458,390 S 6/2002 Ohanesian
D465,036 S 10/2002 Spruill
6,481,696 B1 11/2002 Lion et al.
D471,284 S 3/2003 Heath
6,543,750 B1 4/2003 Calzone
6,557,829 B1 5/2003 Steffes
6,585,234 B2 7/2003 Berto
6,609,702 B1 8/2003 Steffes
6,619,628 B1 9/2003 Steffes
6,619,631 B2 9/2003 Painter
6,622,991 B2 9/2003 Steffes
6,698,725 B1 3/2004 Berry
6,883,786 B2 4/2005 Bebendorf
6,893,008 B2 5/2005 Forbis
6,945,517 B2 9/2005 Augur

* cited by examiner

FENCE POST CAP ASSEMBLY

BACKGROUND OF THE INVENTION

1. Field of the Invention

This invention relates to a fence post cap assembly designed for easy replacement when a post cap is damaged or broken. The fence post cap assembly of the present invention allows for easy installation or reinstallation of post cap without reassembly of the chain links and horizontal top rail or fence post.

2. Description of the Related Art

A wide variety of fencing structures have been used to separate or enclose areas of industrial, commercial, residential and other real estate properties. Common examples of fences include stockade, chain link, wire, and split rail fences. Fencing products may be fabricated from many different materials such as metals, wood, plastic and combination or composites thereof. Conventional fence post caps are either cast metal pieces or fabricated metal pieces.

One of the biggest problems with fence post caps is that they are continuously being damaged by vandalism or even just long term wear and tear. Under conventional methods, if a fence post cap is damaged or broken, the entire or a significant amount of the fence must be disassembled including removal of the horizontal top rail and the chain links. Once a conventional post cap is damaged or destroyed, the top rail and the chain link must be first disassembled to remove the broken cap and then reassembled to insert the new cap and to erect the fence.

The present invention provides for a fence post cap assembly that allows for easy installation without having to disassemble the entire fence including the top rail and chain links. The present invention provides for a plurality of embodiments which potentially could become the industry standards for fence post caps. The present invention can provide a viable and improved cap assembly which can replace conventional caps and once installed, the cap assembly of the present invention, if damaged, can be easily replaced and reinstalled faster than conventional post caps.

SUMMARY OF THE INVENTION

In one embodiment of the present invention, a fence post cap assembly is provided, the assembly comprises a first cap member designed to attach onto a fence post; a second cap member having a circumference larger than the first cap member, the second cap member is designed to fit over the first cap member, the second cap member having at least two apertures; and a loop member having a rounded portion leading to two arms with opposing ends, during an installed position, each of the ends are designed to fit within the apertures of the second cap member while the second cap member is placed over the first cap member thereby locking the loop member and the second cap member onto the first cap member. For purposes of this invention, the term "loop cap" is also called an "eye cap".

In another embodiment, the second cap member has an underside, the underside has grooves which are designed to hold the arms of the loop member during the installed position. In still another embodiment, the arms of the loop member are angled to fit in between the underside of the second cap member and an outer side of the first cap member in the installed position. In yet another embodiment, the assembly of the present invention further comprising at least one vertical and at least one horizontal fence post. For purposes of this invention, the horizontal fence post is also the horizontal top rail.

In still yet another embodiment, the first cap member is situated upon an upper portion of the vertical fence post, the horizontal fence post is situated within the rounded portion of the loop member, the arms and opposing ends of the loop member are inserted into the apertures of the second cap member, the second cap member is attached and locked onto the first cap member. In a further embodiment, the loop member further comprises an extended portion, which is designed to receive barb wire.

In still a further embodiment, the present invention relates to a fence post cap assembly comprising: a cap member designed to attach onto a fence post; a loop member having a rounded portion leading to two opposing arms; and a device for securing the loop member to the cap member during an installed position.

In yet a further embodiment, the loop member further comprises an extended portion which is designed to receive barb wire. In still yet a further embodiment, the securing device is selected from a group consisting of screws, pins, rods, and pegs.

In still yet a further embodiment, the assembly further comprising at least one vertical and at least one horizontal fence post, the cap member is situated upon an upper portion of the vertical fence post, the horizontal fence post is situated within the rounded portion of the loop member, the arms of the loop member is secured onto the extended members of the cap member during an installed position. In another further embodiment, the cap member has a top surface which has at least two extended members, and the loop member is attached to the extended members.

In still another further embodiment, the present invention provides for a fence post cap assembly comprising: a cap member designed to attach onto a fence post, the cap member having a top surface with an aperture and extended member; and a loop member having a rounded portion leading to two opposing arms, a first arm being hingedly attached to the extended member, the second arm capable of being inserted into the aperture of the top surface of the cap member.

In yet another further embodiment, the assembly further comprising a device for hingedly attaching the first arm of the loop member to the extended member of the cap member. In still yet another further embodiment, the attaching device is selected from a group consisting of screws, pins, rods, and pegs.

In another embodiment, the assembly further comprising at least one vertical and at least one horizontal fence post. In still another embodiment, the cap member is situated upon an upper portion of the vertical fence post, the horizontal fence post is situated within the rounded portion of the loop member, the second arm of the loop member is inserted into the aperture of the cap member thereby securing the loop member to the cap member during an installed position.

In yet another embodiment, the second arm of the loop member having an extended end. In still yet another embodiment, the extended end of the second arm is situated in between an underside of the cap member and an outer side of the vertical fence post. In a further embodiment, the loop member is hinged backwards to allow insertion of the horizontal fence post and then hinged forward to allow the second arm to be inserted into the aperture during installation of the assembly to the vertical and horizontal fence posts.

In a further embodiment, the present invention provides for a fence post cap assembly comprising: a first cap member comprising a topside surface and at least one side wall, the side wall having exterior and interior surfaces; a second cap member comprising a topside surface with an opposing underside surface and at least one side wall, the topside surface of the second cap member having a circumference larger than the topside surface of the first cap member, the side wall of the second cap having exterior and interior surfaces, the second cap member is adapted to be fit over the first cap member, the second cap member having at least two apertures on the topside surface; a loop member having a generally rounded portion leading to two arms with two indentations and two terminal ends, and during an installed position, each of the arms is adapted to be fit within each of the apertures of the second cap member while the second cap member is placed over the first cap member thereby locking the loop member and the second cap member onto the first cap member, at least a portion of the indentations of the arms of the loop member are situated between the topside surface of the first cap member and the underside surface of the second cap member during the installed position.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessary to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 2:
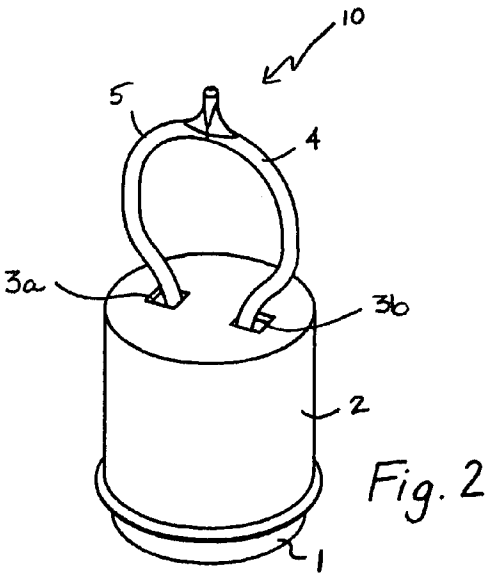
FIG. 2 is a perspective of view of FIG. 1 in an installed position.
Figure 1:
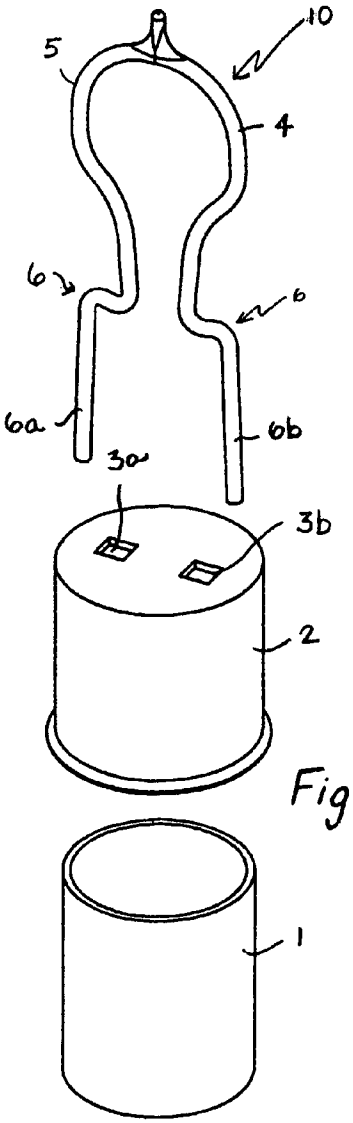
FIG. 1 is a perspective view of one of the embodiments of the fence post assemblies of the present invention in an uninstalled position.
Figure 3:
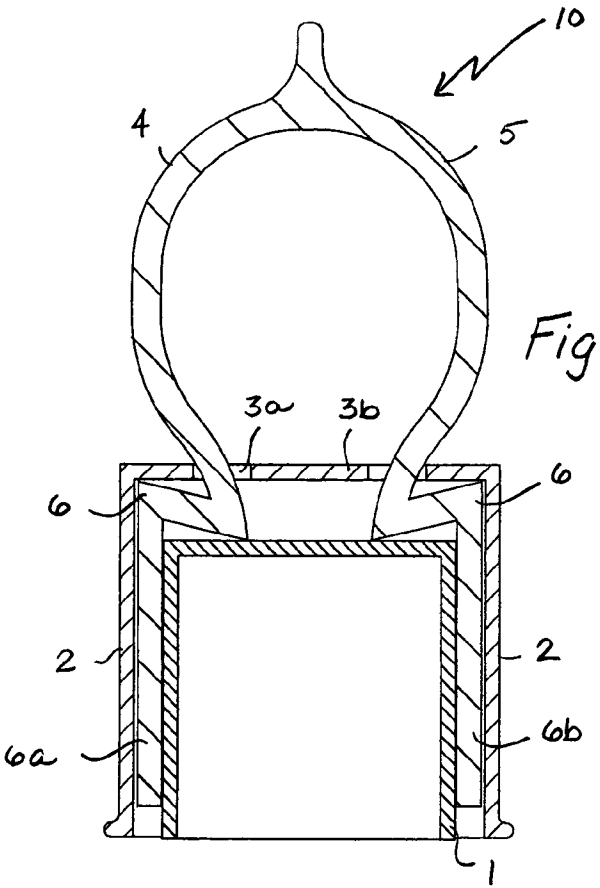
FIG. 3 is a cross-sectional view of FIG. 2.

Referring now to FIGS. 1-3, the present invention provides for a fence post cap assembly 10. The assembly 10 comprises a first cap member 1 designed to attach onto a fence post; a second cap member 2 having a circumference larger than the first cap member 1, and the second cap member 2 is designed to fit over the first cap member 1. The second cap member 2 has at least two apertures, 3*a* and 3*b*. The assembly 10 further comprises a loop member 4 having a rounded portion 5 leading to two arms 6 with opposing ends, 6*a* and 6*b* respectively. During an installed position, each of the ends, 6*a* and 6*b*, are designed to fit within the apertures, 3*a* and 3*b*, of the second cap member 2 while the second cap member 2 is placed over the first cap member 1 to thereby lock the loop member 4 and the second cap member 2 onto the first cap member 1. In another embodiment, the second cap member 2 has an underside, the underside has grooves 11 which are designed to hold the arms 6 of the loop member 4 during the installed position. In still another embodiment, the arms 6 of the loop member 4 are angled to fit in between the underside of the second cap member 2 and an outer side of the first cap member 1 in the installed position.

Figure 4:
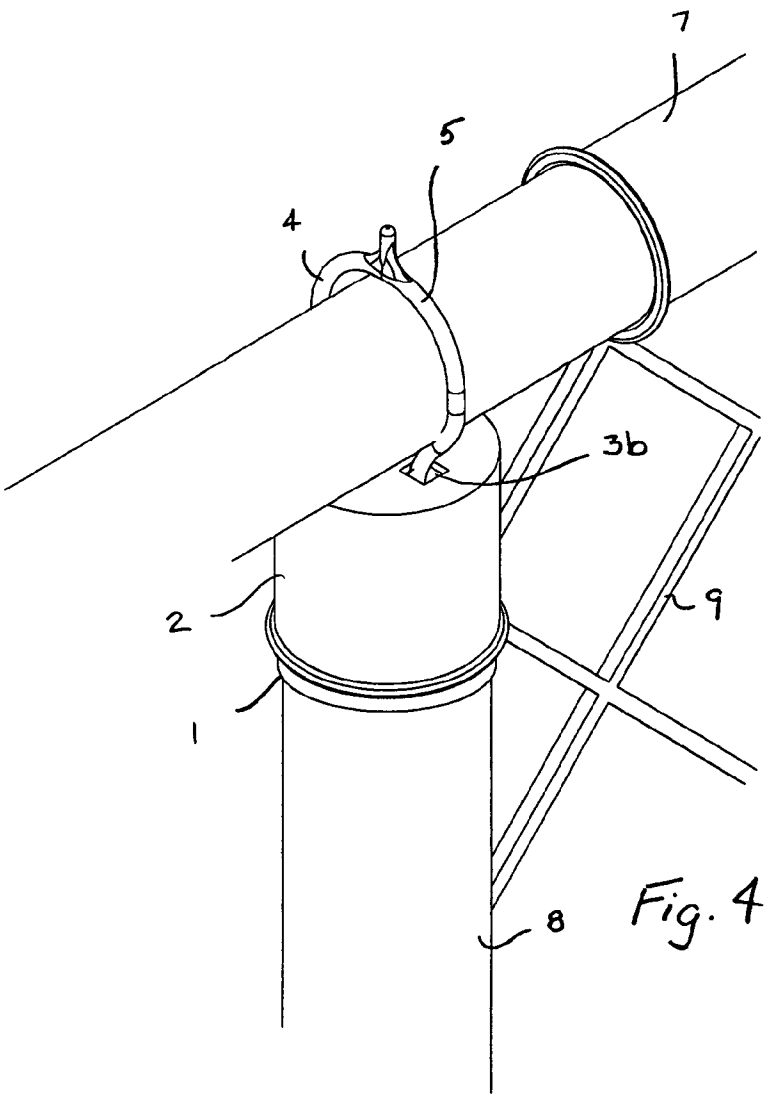
FIG. 4 is a perspective view of FIG. 2 as it relates with a vertical and horizontal posts and chain link fence.

FIG. 4 shows a horizontal fence post 7 placed within the rounded portion 5 of the loop member and a vertical post 8 having a top portion 8*a* attached to the first cap member 1. A chain link fence 9 is then attached to the horizontal post 7 and the vertical post 8.

Figure 5:
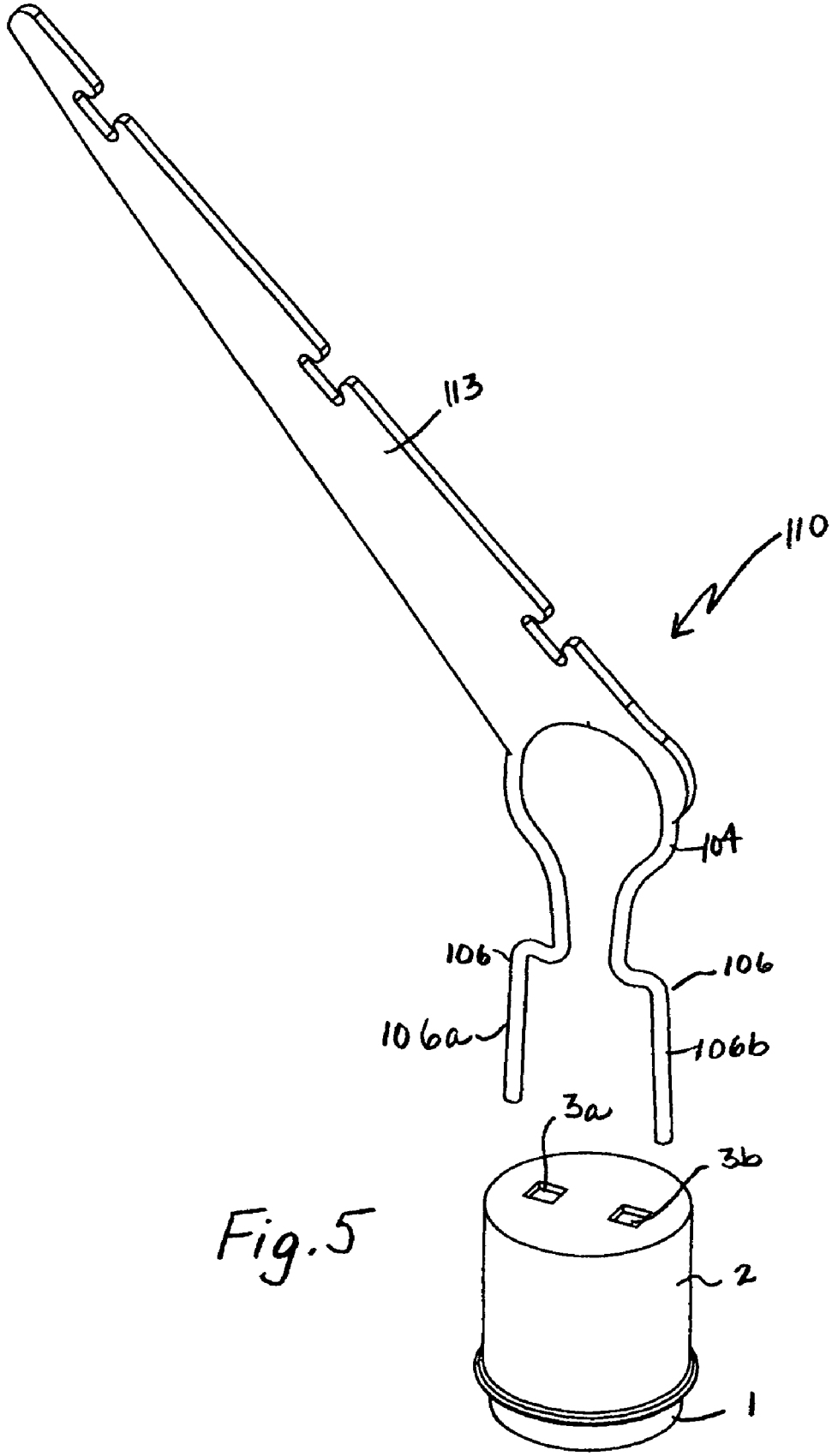
FIG. 5 is a perspective view of FIG. 2 with an extended portion attached to the loop member for receiving barb wire.
Figure 6:
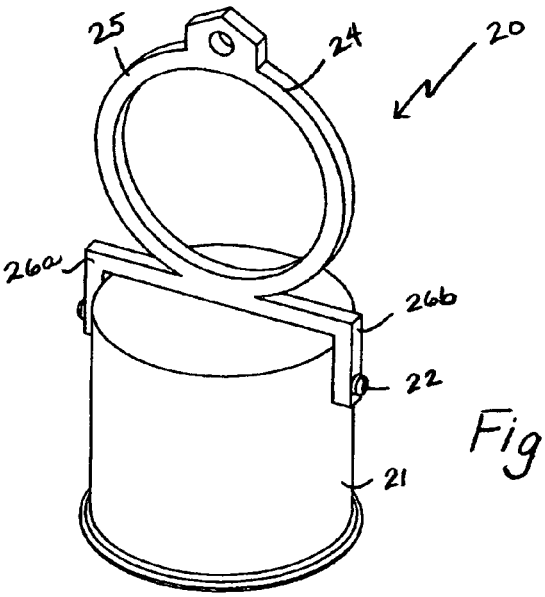
FIG. 6 is a perspective view of another embodiment of the present invention.

FIG. 5 depicts another embodiment of the invention wherein a fence post cap assembly with barb wire extension 100 is provided. The assembly 100 has a loop member 104 with two arms 106 with opposing ends 106*a* and 106*b*. The loop member 104 has an extended portion 113 which is designed to receive barb wire (not shown).

FIGS. 6-9 relates to another embodiment of the present invention which provides for fence post cap assembly 20 comprising: a cap member 21 designed to attach onto a fence post; a loop member 24 having a rounded portion 25 leading to two opposing arms, 26*a* and 26*b*, respectively; and a device 22 for securing the loop member 24 to the cap member 21 during an installed position. In other embodiments, the opposing arms 26*a* and 26*b* are either directly attached to the side of the cap member 21 or on the side wall of the cap member 21.

Figure 7:
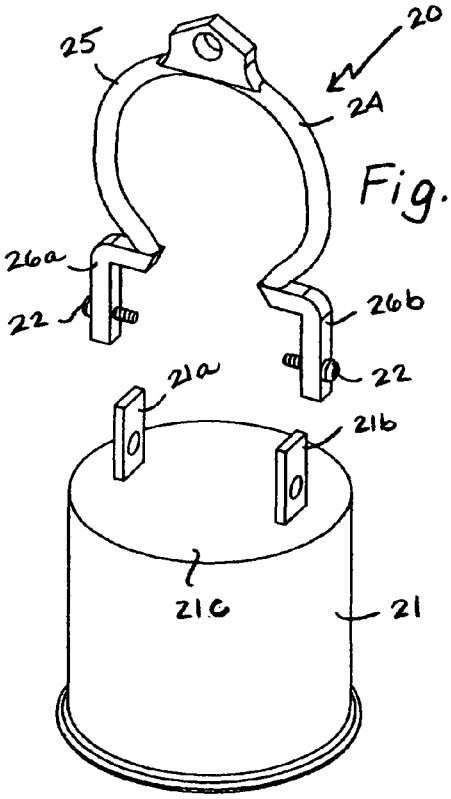
FIG. 7 is a perspective view of another embodiment of FIG. 6.
Figure 8:
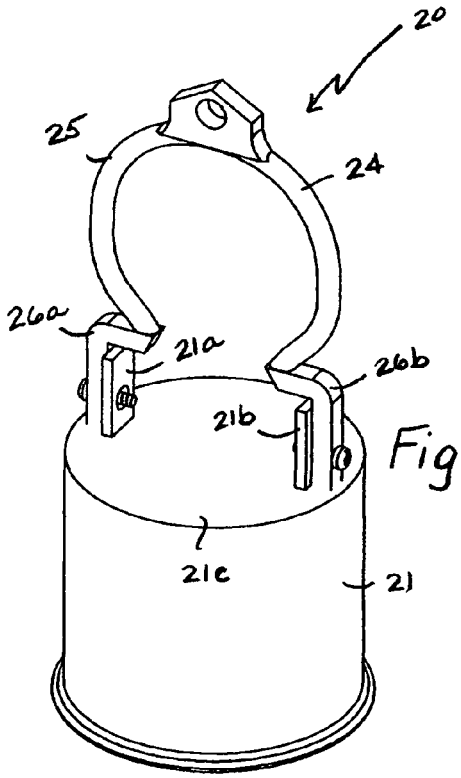
FIG. 8 is a perspective view of FIG. 7 in an installed position.

In another further embodiment shown in FIGS. 7-8, the cap member 21 has a top surface 21*c* which has at least two extended members, 21*a* and 21*b* respectively, and the loop member 24 has opposing arms 26*a* and 26*b* which are attached to the extended members, 21*a* and 21*b*. The securing device 22 is selected from a group consisting of screws, pins, rods, and pegs. The securing device is designed to secure and lock the loop member 24 onto the cap member 21 during installation.

Figure 9:
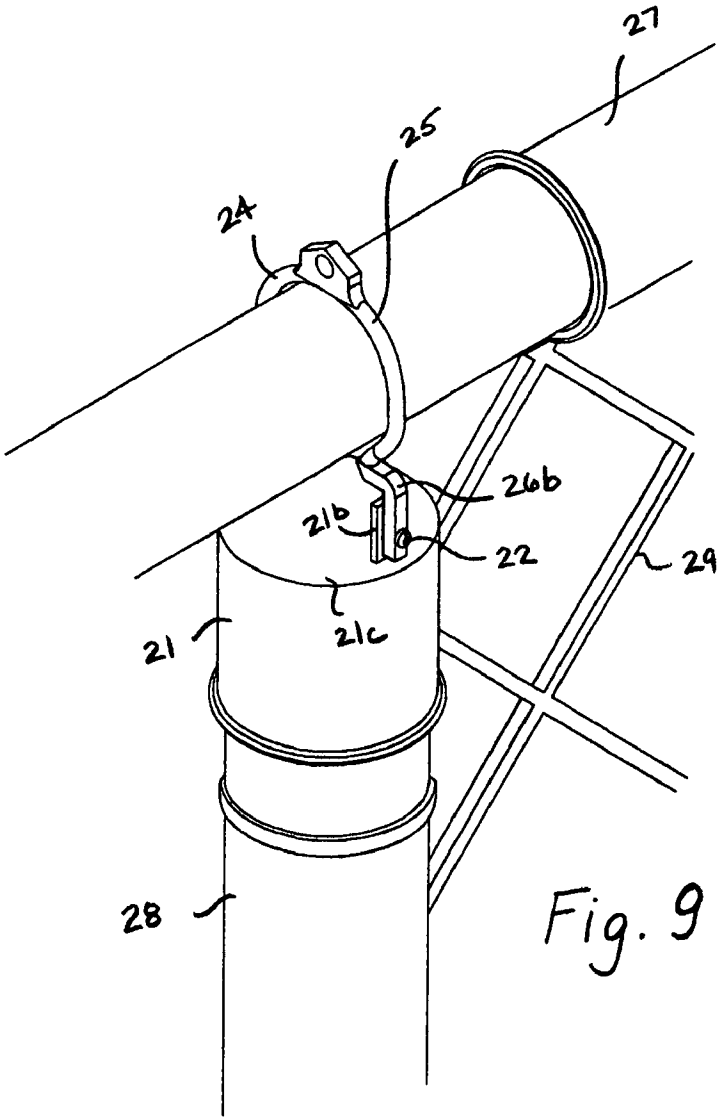
FIG. 9 is a perspective view of FIG. 7 as it relates with a vertical ad horizontal posts and chain link fence.

FIG. 9 illustrates the assembly 20 which further comprises at least one vertical fence post 28 and at least one horizontal fence post 27, and the cap member 21 is situated upon an upper portion 28*a* of the vertical fence post 28. The horizontal fence post 27 is situated within the rounded portion 25 of the loop member 24, and the arms, 26*a* and 26*b*, of the loop member 24 is secured onto the extended members 21*a* and

21*b* of the cap member 21 during an installed position. A chain link fence 29 is attached to the horizontal post 27 and the vertical post 28.

Figure 10:
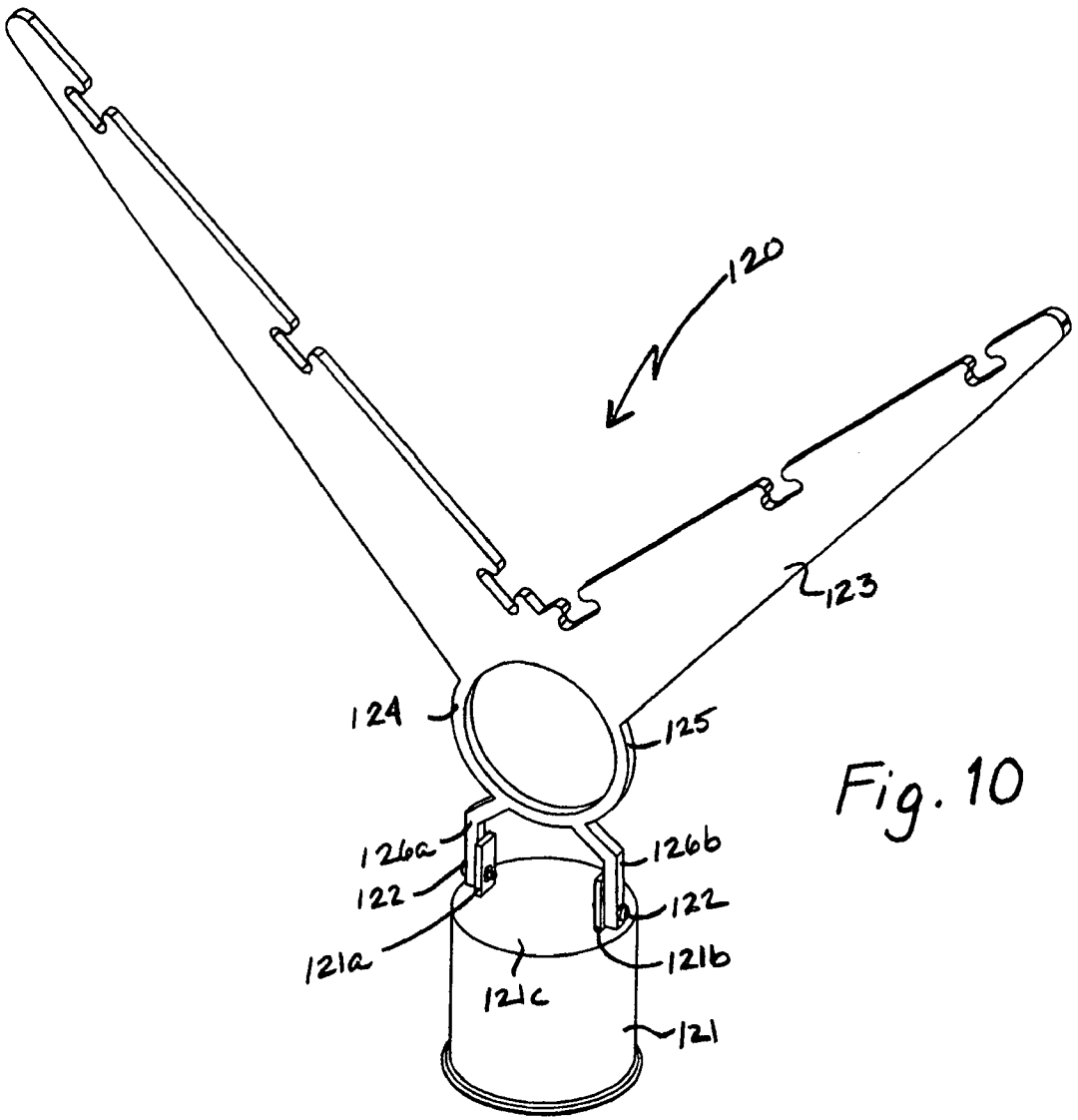
FIG. 10 is a perspective view of FIG. 7 with an extended portion attached to the loop member for receiving barb wire.

FIG. 10 depicts another embodiment of the fence post cap assembly 120 of FIGS. 7-8 with barb wire extensions 123. The cap member 121 has a top surface 121*c* which has at least two extended members, 121*a* and 121*b* respectively, and the loop member 124 has a rounded portion 125 and opposing arms 126*a* and 126*b* which are attached to the extended members, 121*a* and 121*b*. The securing device 122 is selected from a group consisting of screws, pins, rods, and pegs. The securing device is designed to secure and lock the loop member 124 onto the cap member 121 during installation.

Figure 11:
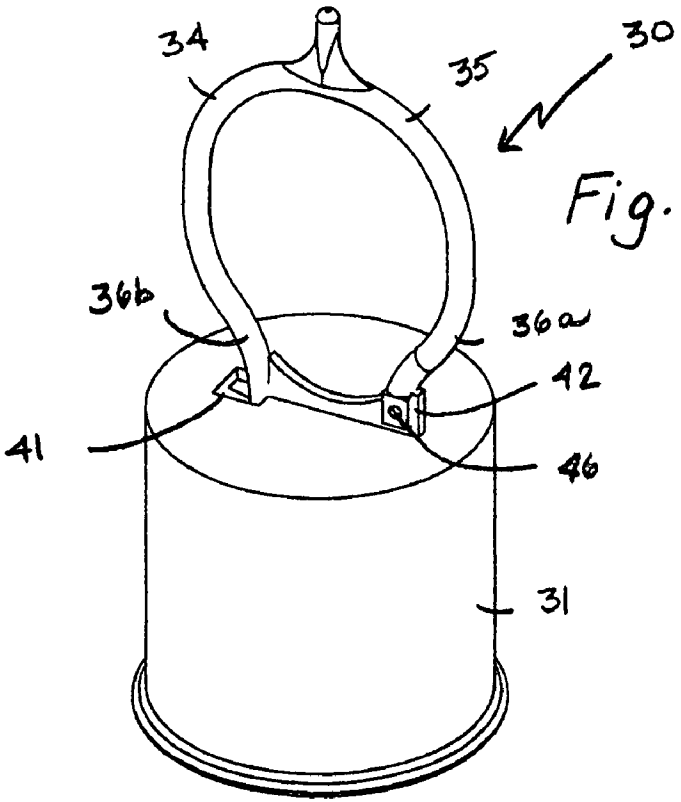
FIG. 11 is a perspective view of another embodiment of the present invention with a hinging loop member in an installed position.
Figure 12:
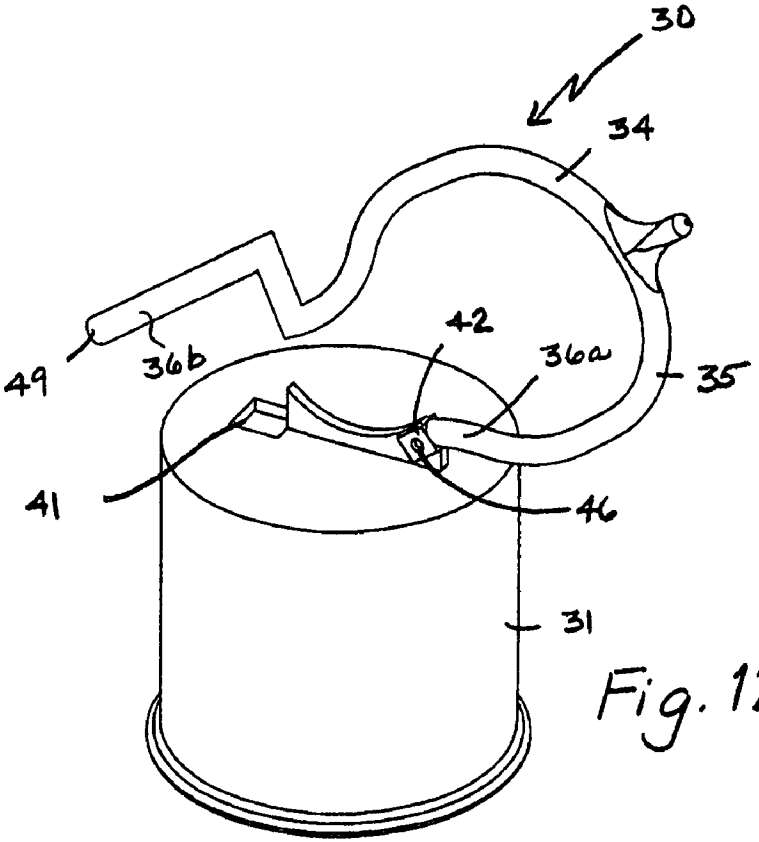
FIG. 12 is a perspective view of FIG. 11 in an uninstalled position.
Figure 13:
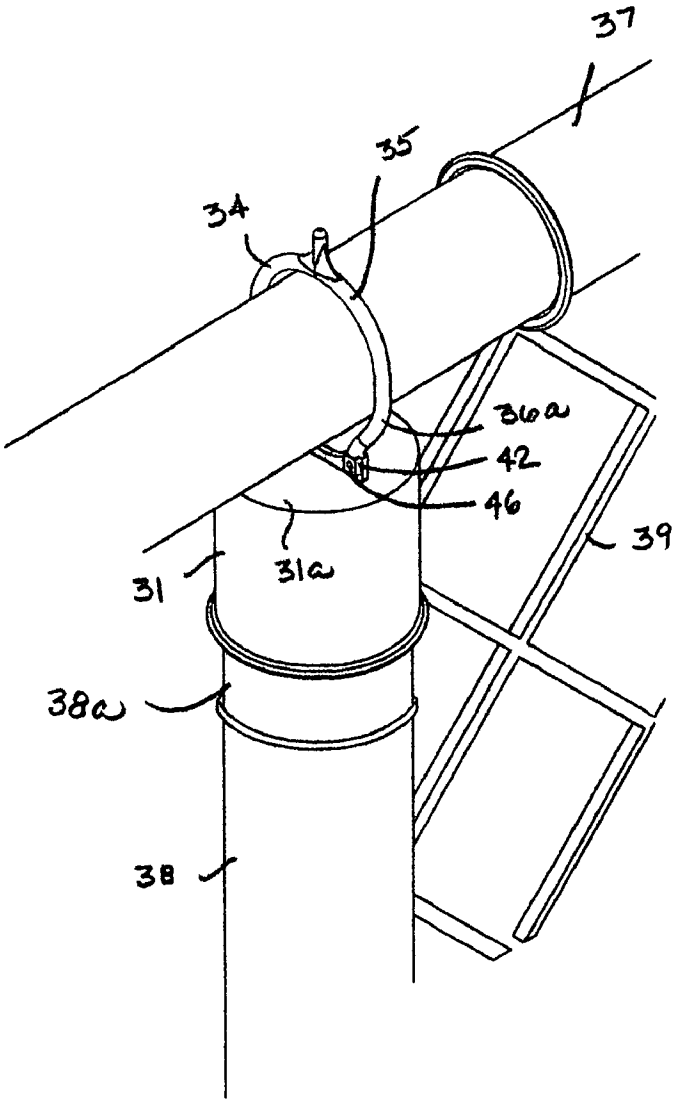
FIG. 13 is a perspective view of FIG. 11 as it relates with a vertical ad horizontal posts and chain link fence.

FIGS. 11-13 relates to another embodiment of the present invention. The present invention provides for a fence post cap assembly 30 comprising: a cap member 31 designed to attach onto a fence post, the cap member 31 having a top surface 31*a* with an aperture 41 and extended member 42; and a loop member 34 having a rounded portion 35 leading to two opposing arms, 36*a* and 36*b* respectively. A first arm 36*a* is hingedly attached to the extended member 42 of the top surface 31*a* of the cap member 31, and the second arm 36*b* capable of being inserted into the aperture 41 of the top surface 31*a* of the cap member 31. The assembly 30 further comprises a device 46 for hingedly attaching the first arm 36*a* of the loop member 34 to the extended member 42 of the cap member 31. In still yet another further embodiment, the attaching device 46 is selected from a group consisting of screws, pins, rods, and pegs.

FIG. 13 shows the assembly 30 further comprises at least one vertical fence post 38 and at least one horizontal fence post 37. In still another embodiment, the cap member 31 is situated upon an upper portion 38*a* of the vertical fence post 38, and the horizontal fence post 37 is situated within the rounded portion 35 of the loop member 31. The second arm 36*b* of the loop member 34 is inserted into the aperture 41 of the cap member 31 to thereby secure the loop member 34 to the cap member 31 during an installed position. The second arm 36*b* of the loop member 31 has an extended end 49. The extended end 49 of the second arm 36*b* is situated in between an underside of the cap member 31 and an outer side of the vertical fence post 38. In a further embodiment, the loop member 34 is hinged backwards to allow insertion of the horizontal fence post 37 and then hinged forward to allow the second arm 36*b* to be inserted into the aperture 41 during installation of the assembly to the vertical and horizontal fence posts.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A fence post cap assembly comprising:

a first cap member comprising a topside surface and at least one side wall, said side wall having exterior and interior surfaces;

a second cap member comprising a topside surface with an opposing underside surface and at least one side wall, said topside surface of said second cap member having a circumference larger than said topside surface of said first cap member, said side wall of said second cap having exterior and interior surfaces, said second cap member is adapted to be fit over said first cap member, said second cap member having at least two apertures on said topside surface;

a loop member having a generally rounded portion leading to two arms with two indentations and two terminal ends, and during an installed position, each of said arms is adapted to be fit within each of said apertures of said second cap member while said second cap member is placed over said first cap member thereby locking said loop member and said second cap member onto said first cap member, at least a portion of said indentations of said arms of said loop member are situated between said topside surface of said first cap member and said underside surface of said second cap member during said installed position; and at least one vertical fence post with an upper portion and at least one horizontal fence post, said first cap member is situated upon said upper portion of said vertical fence post, and at least a portion of said horizontal fence post is situated within said rounded portion of said loop member during said installed position.

2. The assembly of claim 1 wherein at least a portion of said terminal end of each of said arms of said loop member is situated between said exterior surface of said side wall of said first cap member and said interior surface of said side wall of said second cap member during said installed position.

3. The assembly of claim 1 wherein said loop member further comprises an extended portion with at least two opposite ends, said extended portion is designed to receive barb wire, at least a portion of said barb wire being attached to each of said opposing ends of said extended portion.

4. The assembly of claim 1 wherein said topside surfaces of said first and second cap members are generally circular.

5. The assembly of claim 1 wherein said side walls of said first and second cap members are generally cylindrical.

6. A fence post cap assembly comprising:

a first cap member comprising a topside surface and at least one side wall;

a second cap member comprising a topside surface with an opposing underside surface and at least one side wall forming an internal cavity, said second cap member having at least one aperture, said second cap member having a size larger than said first cap member that allows said first cap member to fit within said internal cavity of said second cap member; and a loop member having a fence post receiving portion leading to at least one arm with at least one indentation and at least two terminal ends, and during an installed position, said arm is inserted within said aperture of said second cap member while said second cap member is placed over said first cap member to thereby lock said first cap member within said internal cavity of said second cap member, at least a portion of said indentation of said arm of said loop member is situated between said topside surface of said first cap member and said underside surface of said second cap member during said installed position, said loop member comprises top and bottom side portions, said fence post receiving portion is situated on said top side of said loop member and said terminal ends are situated adjacent said bottom side portions of said loop member, said fence receiving portion is constructed of a metal material with a generally rounded surface area.

7. The assembly of claim 6 wherein said side wall of said first cap member has an exterior surface, said side wall of said second cap member has an interior surface, at least a portion of said terminal end of each of said arms of said loop member is situated between said exterior surface of said side wall of said first cap member and said interior surface of said side wall of said second cap member during said installed position.

8. The assembly of claim 6 further comprising a vertical fence post, said first cap member comprises an internal cavity formed by said side wall, at least a portion of said vertical fence post is adapted to fit within said internal cavity of said first cap member.

9. The assembly of claim 8 wherein said vertical fence post is situated in a vertical position during said installed position.

10. The assembly of claim 8 further comprising a horizontal fence post designed to fit within and be held by said rounded surface area of said fence receiving portion of said loop member.

11. The assembly of claim 10 wherein said horizontal fence post is situated in a horizontal position during said installed position, and said horizontal fence post is generally perpendicular to said vertical fence post.

12. The assembly of claim 6 wherein said loop member further comprises an extended portion with at least two opposite ends, said extended portion is designed to receive barb wire, at least a portion of said barb wire being attached to each of said opposing ends of said extended portion.

13. The assembly of claim 6 wherein said topside surfaces of said first and second cap members are generally circular.

14. The assembly of claim 6 wherein said side walls of said first and second cap members are generally cylindrical.

15. A fence post cap locking apparatus comprising:

a first cap member comprising a generally circular topside surface and at least one generally cylindrical side wall forming an internal cavity;

a second cap member comprising a generally circular topside surface with an opposing underside surface and at least one generally cylindrical side wall forming an internal cavity, said second cap member having at least two apertures leading from said topside surface into said internal cavity of said second cap member, said topside surface of said second cap member having a diameter larger than said topside surface of said first cap member that allows said first cap member to fit within said internal cavity of said second cap member; and a loop member having a generally rounded portion leading to at least two arms with at least two indentations and at least two terminal ends, during an installed position, each of said arms is inserted within each of said apertures of said second cap member while said second cap member is placed over said first cap member to thereby lock said first cap member within said internal cavity of said second cap member, at least a portion of said terminal end of each of said arms of said loop member is situated between said exterior surface of said side wall of said first cap member and said interior surface of said side wall of said second cap member during said installed position, said loop member comprises top and bottom side portions, said generally rounded portion is situated on said top side of said loop member and said terminal ends are situated adjacent said bottom side of said loop member, said generally rounded portion is constructed of a metal material and designed for receiving and holding a fence post.

16. The apparatus of claim 15 further comprising at least one vertical fence post, at least a portion of said vertical fence post is situated within said internal cavity of said first cap member during said installed position.

17. The apparatus of claim 15 further comprising at least one horizontal fence post, at least a portion of said horizontal fence post is situated within said rounded portion of said loop member during said installed position.

* * * * *